US009604447B2

(12) United States Patent
Nadachi et al.

(10) Patent No.: US 9,604,447 B2
(45) Date of Patent: Mar. 28, 2017

(54) APPARATUS FOR WASHING OFF INK IN FLEXOGRAPHIC PRINTING PRESS AND METHOD FOR WASHING OFF INK IN FLEXOGRAPHIC PRINTING PRESS

(71) Applicant: MITSUBISHI HEAVY INDUSTRIES PRINTING & PACKAGING MACHINERY, LTD., Mihara-shi, Hiroshima (JP)

(72) Inventors: Mitsuhiro Nadachi, Mihara (JP); Osamu Hatano, Mihara (JP)

(73) Assignee: MITSUBISHI HEAVY INDUSTRIES PRINTING & PACKAGING MACHINERY, LTD., Mihara-Shi, Hiroshima (JP)

( * ) Notice: Subject to any disclaimer, the term of this patent is extended or adjusted under 35 U.S.C. 154(b) by 0 days.

(21) Appl. No.: 14/911,589

(22) PCT Filed: Sep. 4, 2014

(86) PCT No.: PCT/JP2014/073305
§ 371 (c)(1),
(2) Date: Feb. 11, 2016

(87) PCT Pub. No.: WO2015/068453
PCT Pub. Date: May 14, 2015

(65) Prior Publication Data

US 2016/0185104 A1 Jun. 30, 2016

(30) Foreign Application Priority Data

Nov. 5, 2013 (JP) ..... 2013-229258

(51) Int. Cl.
*B41F 35/00* (2006.01)

(52) U.S. Cl.
CPC ..... *B41F 35/00* (2013.01); *B41F 35/008* (2013.01); *B41P 2235/27* (2013.01)

(58) Field of Classification Search
CPC ..... B41F 35/04
(Continued)

(56) References Cited

U.S. PATENT DOCUMENTS 5,051,758 A * 9/1991 Markham ..... B41J 2/16552 347/28
5,402,724 A * 4/1995 Yaeso ..... B41F 35/04 101/424
(Continued)

FOREIGN PATENT DOCUMENTS

EP 2218582 A1 8/2010
JP H09-201952 A 8/1997
(Continued)

OTHER PUBLICATIONS

PCT/IB/338, "International Preliminary Report on Patentability for PCT/JP2014/073305," May 19, 2016.
(Continued)

*Primary Examiner* — Anthony Nguyen
(74) *Attorney, Agent, or Firm* — Manabu Kanesaka

(57) ABSTRACT

An apparatus includes a washing water supplying path connected to an ink chamber, including a seal blade and a doctor blade slidably contacting an outer circumference of an anilox roll; a washing water supplier for supplying washing water to an inside of the ink chamber through the washing water supplying path; a supplying path opening/closing device that opens and closes the washing water supplying path; a washing water recovering paths connected to the ink chamber; a suction recovering device that recovers the washing water in the ink chamber by suction through the washing water recovering path; and a controller that controls
(Continued)

operations of the washing water supplier, the supplying path opening/closing device, and the suction recovering device. The control mode includes a decompression control mode in which the seal blade is elastically deformed towards the ink chamber by decompressing the inside of the ink chamber by recovering the washing water.

12 Claims, 2 Drawing Sheets

(58) Field of Classification Search
USPC ..... 101/425
See application file for complete search history.

(56) References Cited

U.S. PATENT DOCUMENTS 5,517,918 A * 5/1996 Van Denend ..... B41F 31/027 101/363
5,826,509 A * 10/1998 Deneka ..... B41F 31/027 101/366
5,967,044 A * 10/1999 Marschke ..... B41F 9/065 101/363
8,096,237 B2 * 1/2012 Bitterich ..... B41F 23/08 101/130
2007/0146412 A1 * 6/2007 Gydesen ..... B41F 31/027 347/28
2010/0295892 A1 11/2010 Riera Garriga et al.
2012/0167791 A1 * 7/2012 Nadachi ..... B41F 35/04 101/425

FOREIGN PATENT DOCUMENTS

JP H10-296961 A 11/1998
JP H10-296962 A 11/1998
JP 2011-98478 A 5/2011
JP 2012-106192 A 6/2012

OTHER PUBLICATIONS

Europe Patent Office, "Search Report for European Patent Application No. 14860473.9," Aug. 1, 2016.
PCT, "International Search Report for International Application No. PCT/JP2014/073305".

* cited by examiner

APPARATUS FOR WASHING OFF INK IN FLEXOGRAPHIC PRINTING PRESS AND METHOD FOR WASHING OFF INK IN FLEXOGRAPHIC PRINTING PRESS

RELATED APPLICATIONS

The present application is National Phase of International Application No. PCT/JP2014/073305 filed Sep. 4, 2014, and claims priority from Japanese Application No. 2013-229258, filed Nov. 5, 2013, the disclosure of which is hereby incorporated by reference herein in its entirety.

TECHNICAL FIELD

The present invention relates to an apparatus for washing off an ink in a flexographic printing press and a method for washing off an ink in a flexographic printing press.

BACKGROUND TECHNIQUE

A flexographic printing press, which is installed on, for example, a manufacturing line of corrugated board boxes, carries out printing by supplying an ink in an ink chamber formed along the longitudinal axis direction of an anilox roll into the cells on the outer circumference face of the anilox roll and further transferring the ink on the anilox roll to a printing plate. The ink in the ink chamber circulates by being supplied from an ink can through a supplying pipe and returning to the ink can through a returning pipe.

In changing of an ink of such a flexographic printing press, recovering the ink, washing the ink circulating path, and circulating the next ink are required. It is important to accomplish this changing procedure in a shorter time to enhance the working efficiency of the printing press. In particular, the art has a problem of shortening the time that washing takes by efficiently washing inside the ink circulating path. Since an ink used for a flexographic printing is usually water-base ink, it is possible to use water to wash the ink circulating path.

In order to solve the above problem, Patent Literature 1 discloses a technique of flowing a the mixture of the washing water and air at a high velocity by mixing compressed air into the circulating path when the washing water is circulating the ink circulating path. This can enhance the washing efficiency of the inside of the ink chamber by an agitating action and a turbulent flow forming action of the washing water by bubbles and an energy of high-velocity flow of the washing water.

Here, an ink chamber is defined as a space enclosed by a chamber frame arranged opposite to the outer circumference face of an anilox roll, a seal blade installed at the top end of the chamber frame, a doctor blade installed at the bottom end of the chamber frame, the anilox roll that rotates in contact with these blades, and side plates. The outer circumference face of the anilox roll rotates in the direction of from the seal blade to the doctor blade. An ink in the ink chamber is applied to the outer circumference of the anilox roll in the range between these blades, and the surplus ink thereon is scraped off by the doctor blade.

When the outer circumference face of the anilox roll enters the seal blade, an ink remaining on the outer circumference face of the anilox roll adheres to the upper surface side of the seal blade, and the adhering ink gradually gathers in the V-shaped space formed between the upper surface of the seal blade and the outer circumference face (sic) of the anilox roll. If the ink on the upper surface of the seal blade is not removed when the ink is to be changed, the ink after the changing is to be contaminated with the left ink. Besides, if the ink on the upper surface of the seal blade is not removed when the printing press is being washed, the left ink adheres to the anilox roll again to clog the cells. For the above, the left ink on the upper surface needs to be washed off when the printing press is being washed.

Above the seal blade, a pipe to supply dampening water to the outer circumference face of the anilox roll is arranged. The dampening water is used to adjust the ink concentration, avoid fixation of the ink to the side plates, and prevent the ink from sticking to the cells on the surface of the anilox roll being gradually dried as the ink in the ink chamber reduces when the ink is changed to another ink and from consequent clogging the cells. The technique disclosed in Patent Literature 1 supplies the dampening water from the pipe to the anilox roll when washing the printing press, which means the dampening water functions as washing water capable of washing off the ink adhered to the upper surface side of the seal blade.

PRIOR ART REFERENCE

Patent Literature

[Patent Literature 1] Japanese Laid-open Patent Publication No. 2011-98478

SUMMARY OF INVENTION

Problem(s) to be Solved by Invention

However, even if the adhering ink is washed off by supplying water onto the upper surface side of the seal blade, the washing water remains at the V-shaped portion formed between the upper surface of the seal blade and the outer circumference face of the anilox roll. The remaining washing water drains off from the both end of the V-shaped portion by its own weight. Some printing press has an anilox roll and a seal blade as long as three meters, which takes the washing water remaining at the V-shaped portion long time to spontaneously drains off and consequently hinders the washing from being accomplished in a short time.

As a solution to the above, a demand has arisen for a technique capable of rapidly removing the washing water at the V-shaped portion.

When compressed air is used for washing likewise the technique of Patent Literature 1, the compressed air may be used for removing the washing water at the V-shaped portion. Specifically, an air-blowing nozzle is arranged above the seal blade, air is blown from a point above or obliquely above the V-shaped portion, and the air-blowing force pushes off the washing water on the upper surface of the seal blade.

Unfortunately, although Inventor(s) attempted the above scheme, Inventor(s) found that the washing water blew up to dirt the surroundings.

Furthermore, Inventor(s) found that this scheme required an additional cost for the air-blowing nozzle and it was difficult to set the optimum location (height) and direction (angle) of the air-blowing nozzle to push off the washing water on the upper surface of the seal blade in a short time.

With the foregoing problem in view, the object of the present invention is to provide an apparatus and a method for washing off an ink in a flexographic printing press that is capable of rapidly removing the washing water remaining on the seal blade while suppressing a cost increase.

Means to Solve the Problem(s)

(1) An apparatus for washing off an ink in a flexographic printing press according to the present invention includes: a washing water supplying path that is connected to an ink chamber, the ink chamber being including a seal blade and a doctor blade being in slidable contact with an outer circumference of an anilox roll; a washing water supplier that supplies washing water to an inside of the ink chamber through the washing water supplying path; a supplying path opening/closing device that opens and closes the washing water supplying path; a washing water recovering path that is connected to the ink chamber; a suction recovering device that recovers the washing water in the ink chamber by suction through the washing water recovering path; and a controller that controls operations of the washing water supplier, the supplying path opening/closing device, and the suction recovering device accordance with a predetermined control mode, wherein the control mode includes a decompression control mode in which the seal blade is elastically deformed towards the ink chamber by decompressing the inside of the ink chamber by recovering the washing water by suction generated by activating the suction recovering device and closing the washing water supplying path by the supplying path opening/closing device.

(2) The seal blade may preferentially be made of a material having a lower stiffness than that of the doctor blade.

(3) The apparatus may preferentially further include an ink supplying path that is connected to the ink chamber; an ink supplier that supplies ink to the inside of the ink chamber through the ink supplying path; and an ink recovering path that is connected to the ink chamber, the ink supplying path and the ink recovering path may be used as the washing water recovering path; and the ink supplier may be used as the suction recovering device.

(4) The ink supplier may preferentially be a forward-reverse switchable pump that pumps the ink into the inside of the ink chamber when being forwardly driven and sucks the ink in the ink chamber when being reversely driven.

(5) The apparatus may preferentially further include a hopper that is disposed at each end of the ink chamber and that receives an ink flowing from the end, and the ink recovering path may include a flowing ink recovering path that recovers the ink flowing into the hopper, and a direct ink recovering path that is directly connected to the ink chamber.

(6) A plurality of the control modes may preferentially further include: a washing mode in which the inside of the ink chamber is washed through supplying the washing water to the inside of the ink chamber by activating the washing water supplier, under a state where the washing water supplying path is opened by the supplying opening/closing device, and recovering the washing water in the ink chamber by suction generated by activating the suction recovering device; and a washing water recovering mode in which the washing water in the ink chamber is recovered by suction through stopping the washing water supplier, under a state where the washing water supplying path is opened by the supplying path opening/closing device, and activating the suction recovering device, and the controller may carry out the washing mode and the washing water recovering mode in this order, and may carry out the decompression control mode immediately before the washing water recovering mode.

(7) The apparatus may preferentially further include a first compressed air supplier, being provided for the washing water supplier, that mixes compressed air with the washing water to be supplied and flows a multiphase fluid including a gas phase and a fluid phase inside the ink chamber.

(8) The washing water supplier may preferentially include a washing water tank that is disposed above the ink chamber and that supplies the washing water using an own weight of the washing water, and a plurality of the control modes may preferentially further include: a washing mode in which the inside of the ink chamber is washed through supplying the washing water to the inside of the ink chamber using the own weight of the washing water by activating the washing water supplier, under a state where the washing water supplying path is opened by the supplying path opening/closing device, and recovering the washing water in the ink chamber by suction through activating the suction recovering device; a forcible washing mode in which the inside of the ink chamber is washed through forcibly suppling the multiphase fluid to the inside of the ink chamber by activating the washing water supplier and the first compressed air supplier, under a state where the washing water supplying path is opened by the supplying path opening/closing device, and recovering the washing water in the ink chamber by suction generated by activating the suction recovering device; and a washing water recovering mode in which the washing water in the ink chamber is recovered by suction through stopping the washing water supplier, under a state where the washing water supplying path is opened by the supplying path opening/closing device, and activating the suction recovering device, and the controller may preferentially carry out the washing mode, the forcibly washing mode, and the washing water recovering mode in this order, and may preferentially carry out the decompression control mode immediately before the washing water recovering mode.

(9) The apparatus may preferentially further include a second compressed air supplier, being included in the washing water recovering path, that enhances the recovering of the washing water by mixing compressed air with the washing water to be recovered in a direction of the recovering.

(10) The controller sequentially may carry out a plurality of the control modes on a predetermined schedule.

(11) A method for washing off an ink in a flexographic printing press of the present invention includes: washing an inside of an ink chamber by suppling the inside of the ink chamber with washing water, the ink chamber including a seal blade and a doctor blade being in slidable contact with an outer circumference of an anilox roll; and after the washing, recovering the washing water in the ink chamber, immediately before the recovering, decompressing the inside of the ink chamber to elastically deform the seal blade towards the ink chamber.

(12) The washing may preferentially supply the washing water by an own weight of the washing water; and the method may preferentially further include, between the washing and the decompressing, forcibly washing the inside of the ink chamber by forcibly flowing a multiphase fluid including a gas phase and a fluid phase in the ink chamber, the multiphase fluid being generated by mixing compressed air with the washing water.

Effects of Invention

According to the present invention, when the washing water in the ink chamber is being recovered, the inside of the ink chamber is decompressed to elastically deform the seal blade towards the ink chamber, so that the washing water remaining on the seal blade can be rapidly drawn into the ink chamber. Consequently, the washing water on the seal blade can be rapidly removed. In addition, since the washing water is recovered by suction generated by reversely driving the pump that supplies an ink, increase of the cost for removal of the washing water on the seal blade can be suppressed.

BRIEF DESCRIPTION OF DRAWINGS

FIG. 1A being a perspective view of the main part; and FIG. 1B being a cross sectional view.

EMBODIMENTS TO CARRY OUT INVENTION

Hereinafter, an embodiment of the present invention will now be described with reference to the accompanying drawings.

The following embodiment is merely exemplary and there is no intention to exclude modification and application of another technique that the following embodiment does not explicitly describe. The embodiment may be partially carried out, partially modified, and replaced by another mechanism or apparatus having a similar function.

[Configurations of a Flexographic Printing Press and an Apparatus for Washing Off an Ink]

Figure 1A:
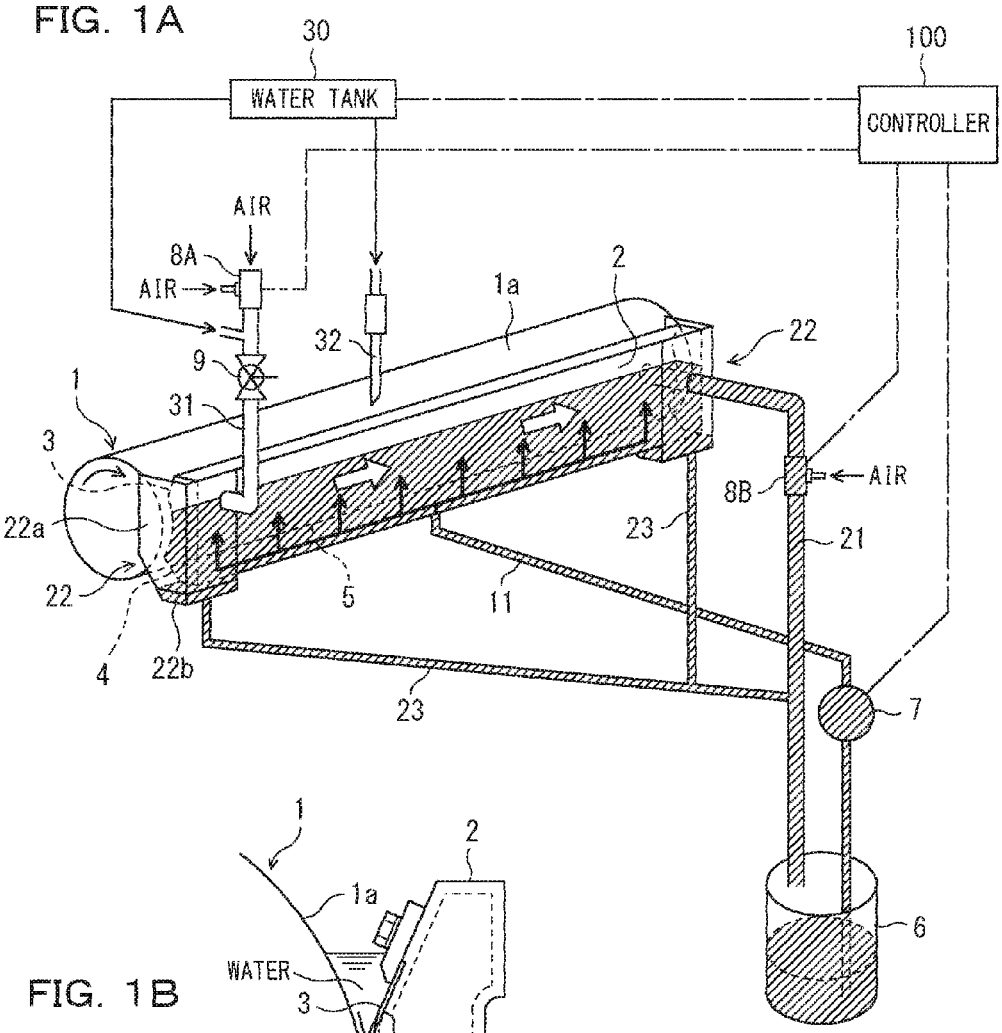
FIGS. 1A and 1B are diagrams illustrating the main part of a flexographic printing press according to one embodiment of the present invention.
Figure 1B:
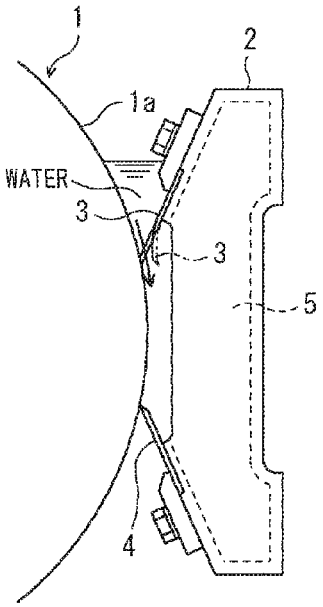

As illustrated in FIGS. 1A and 1B, the flexographic printing press of this embodiment includes an anilox roll 1, a chamber frame 2 arranged along one side of the anilox roll 1, a seal blade 3 disposed at the top portion of the opening face of the chamber frame 2 toward the anilox roll 1, and a doctor blade 4 arranged at the bottom portion of the opening face. The hatching in FIG. 1A represents an ink circulating in the apparatus while printing is being carried out.

An ink chamber 5 is formed by being surrounded by the chamber frame 2, the seal blade 3, the doctor blade 4, the outer circumference face of the anilox roll 1, and non-illustrated side plates.

The seal blade 3 seals the ink chamber 5, and, for this purpose, is formed to be relatively thin by using a soft resin (e.g., soft polyethylene) having a relatively low stiffness. In contrast, the doctor blade 4 scrapes off a surplus ink adhering to the surface of the anilox roll 1 and, for this purpose, is formed to be relatively thick by using a hard resin (e.g., hard polyethylene, such as ultra high molecular weight (UHMW) polyethylene) having a relatively high stiffness.

To the ink chamber 5, an ink supplying pipe (ink supplying path) 11 and an ink returning pipe (ink direct recovering path serving as an ink recovering path) 21 are connected.

One end of the ink supplying pipe 11 is placed into an ink can (ink tank) 6 and an ink supplying and recovering pump (ink supplier, hereinafter simply called a pump) 7 is interposed into the ink supplying pipe 11. The other end of the ink supplying pipe 11 is connected to the center portion of the longitudinal direction of the ink chamber 5, in which a non-illustrated supplying path are formed to uniformly distribute the ink provided through the ink supplying pipe 11 in the longitudinal direction.

One end of the ink returning pipe 21 is connected to an ink returning outlet at one of the ends of the ink chamber 5. The other end of the ink returning pipe 21 is introduced in the upper portion of the ink can 6. In the vicinity of the one end of the ink returning pipe 21, an air gun (second compressed air supplier) 8B that enhances the recovering of the ink by mixing the ink with compressed air towards the direction of recovering an ink is disposed. The air gun 8B is capable of selectively blowing low-pressurized air and high-pressurized air.

At the each end of the ink chamber 5, a hopper 22 is disposed to receive an ink flowing out of the end. The hopper 22 includes an edge plate 22*a* surrounding the edges of the chamber frame 2, the seal blade 3, the doctor blade 4, the anilox roll 1 and the surroundings the edges, and a box-shaped hopper unit 22*b* being disposed under the edge plate 22*a*. To the hopper unit 22*b*, the other end of an ink returning pipe (flowing ink recovering path as the ink recovering path) 23 is connected to join into a midpoint of the ink returning pipe 21.

Above the ink chamber 5, dampening water supplying pipes 31 and 32 are disposed which supply water (dampening water) to adjust the ink concentration, avoid fixation of the ink to the side plates, and prevent the ink from sticking to the cells on the surface of the anilox roll 1 being gradually dried as the ink in the ink chamber 5 reduces when the ink is changed to another ink and from consequent clogging the cells.

Upstream of the dampening water supplying pipes 31 and 32, a water tank 30 is arranged which can switch itself between a water supplying state and a water supply halting state. Switching the water tank 30 to the water supplying state causes the dampening water supplying pipes 31 and 32 to supply the dampening water. Accordingly, the water tank 30 functions as a dampening water supplier. A dampening water supplier is not limited to a simple water tank, and alternatively may be a pump that pumps the dampening water.

The dampening water supplying pipe 31 is introduced into the ink chamber 5; and the dampening water supplying pipe 32 is introduced to the top surface of the seal blade 3. Further, on the dampening water supplying pipe 31, an open/close valve (supplying path opening/closing device) 9 and an air gun (first compressed air supplier) 8A disposed above (upstream) of the open/close valve 9 are arranged.

When an ink is washed off, the dampening water supplying pipes 31 and 32 are used as washing water supplying pipes (washing water supplying path), and the ink supplying pipe 11 and the ink returning pipes 21 and 23 are used as washing water recovering pipes (washing water recovering path).

The pump 7 is a forward/reverse switchable pump that pumps the ink in the ink can 6 to the ink chamber 5 while forwardly rotating, and sucks the ink in the ink chamber 5 to reclaim the ink while reversely rotating. The pump 7 functions as a suction recovering device that sucks the washing water in the ink chamber 5 when the washing off the ink.

The dampening water supplier (water tank) 30 is configured to change an amount of water supply (per unit time) under the water supplying state. In supplying the dampening water, the dampening water supplier 30 supplies a small amount of water as the dampening water while in washing off the ink, the dampening water supplier 30 supplies a large amount of water as the washing water. In washing off the ink, the dampening water supplier (water tank) 30 functions as a washing water supplier.

The air gun 8A puts, in washing off the ink, compressed air into the washing water supplied through the dampening water supplying pipe 31 and thereby flows (circulates) a multiphase fluid formed of a gas phase and a liquid phase in the ink chamber 5. The ink chamber 5 is efficiently washed by a washing action of the multiphase fluid, that is, the washing action due to an agitating action and a turbulent flow forming action of the washing water by bubbles and the washing action due to an energy of the high-velocity flow of the washing water. In addition, the washing can be completed by a small amount of washing water.

The other air gun 8B blows low-pressure air and encourages recovering of the ink without bubbling the ink in recovering the ink while blows high-pressure air and rapidly recovers washing water in recovering the washing water.

The open/close valve 9 is made into a close state while the ink is circulating and is made into an open state while the ink is washed off. When the pump 7 and the air gun 8B reclaim the washing water in the ink chamber 5 in washing off the ink, the open/close valve 9 is used to decompress the inside of the ink chamber 5 by being made into the close state to shut the dampening water supplying pipe 31. Decompressing the inside of the ink chamber 5 elastically deforms the seal blade 3, which is made of a material having a low stiffness and which is thin, towards inside of the ink chamber 5. In contrast, the doctor blade 4, which is made of a material having a high stiffness and which is thick, is hardly elastically deformed. The rotating direction of the outer circumference face of the anilox roll 1 enhances the elastic deformation of the seal blade 3 and inhibits the elastic deformation of the doctor blade 4.

The above control on the pump 7, the air guns 8A and 8B, the open/close valve 9, and the dampening water supplier (water tank) 30 is carried out by the controller 100.

[Apparatus and Method for Washing Off an Ink]

The control modes for changing an ink includes: an ink recovering mode in which an ink having been used in the ink chamber 5 is recovered; a washing mode in which the inside of the ink chamber 5 is washed through supplying the washing water to the inside of the ink chamber 5 after the ink has been recovered; a forcible washing mode in which the inside of the ink chamber 5 is washed through forcibly suppling the multiphase fluid by activating the air gun 8A after the washing water is sufficiently supplied to the inside of the ink chamber 5; and a washing water recovering mode in which the washing water in the ink chamber 5 is recovered. In addition to the above modes, the present invention uniquely includes a decompression control mode in which the inside of the ink chamber 5 is decompressed.

As illustrated in FIGS. 2A to 2G, the control modes are carried out the ink recovering mode, the washing mode, the forcible washing mode, the decompression control mode, and the washing water recovering mode in this order. In FIGS. 2A to 2G, oblique hatching represents the ink inside the apparatus and lateral hatching represents the washing water in the system.

Figure 2A:
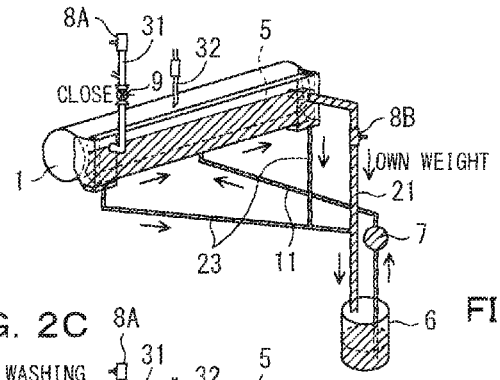
FIGS. 2A-2G are perspective views illustrating an apparatus for washing off an ink and a method for washing off an ink in a flexographic printing press of the one embodiment; the procedure of washing off the ink being carried out in the order of FIGS. 2A through 2G.

Namely, immediately before the ink is changed, an ink circulating mode of the ink that has been used is being carried out as illustrated in FIG. 2A. In the ink circulating mode, the open/close valve 9 is closed, the air guns 8A and 8B and the dampening water supplier (water tank) 30 are deactivated, and the pump 7 is forwardly driven. Under this state, the ink is supplied from the ink supplying pipe 11 to the ink chamber 5, and a surplus ink returns through the ink returning pipe 21 to the ink can 6 by its own weight, and an ink flown out of each end of the ink chamber to be collected by the hopper 22 returns through the ink returning pipes 23, 21 to the ink can 6 by its own weight. Thereby, the ink circulates. While the ink is circulating, the ink in the ink chamber 5 flows from an edge connected to the dampening water suppling pipe 31 to the other edge connected to the ink returning pipe 21. The pump 7 switches between high-speed supplying and low-speed supplying according to the requirement.

Figure 2B:
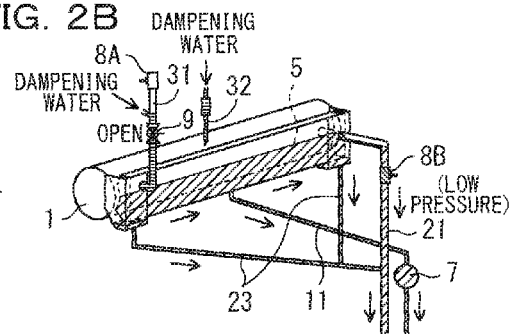

In changing the ink, an ink recovering mode is carried out as illustrated in FIG. 2B. In this ink recovering mode, the open/close valve 9 is opened and the air gun 8B is operated in a low pressure, the dampening water supplier (water tank) 30 is activated (supplying the dampening water), and the pump 7 is reversely driven at a high speed. Thereby, the ink in the ink chamber 5 is recovered to the ink can 6 through the ink supplying pipe 11, the ink in the ink returning pipe 21 returns to the ink can 6 by the suction of the air gun 8B, and the ink recovered in the hoppers 22 returns to the ink can 6 through the ink returning pipes 23 and 21 by its own weight. Supplying the dampening water through the dampening water supplying pipes 31 and 32 can prevent the outer circumference face of the anilox roll 1 from drying.

Figure 2C:
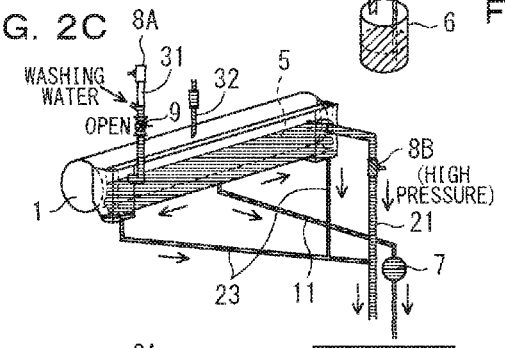

After the ink recovering mode is completed, a washing mode is carried out as illustrated in FIG. 2C. In the washing mode, the open/close valve 9 is opened and the air gun 8B is operated in a high pressure, the dampening water supplier (water tank) 30 is activated (washing water supplying), and the pump 7 is reversely driven at a high speed. In this mode, the ink can 6 is substituted by a drainage hopper 10. Thereby, the washing water in supplied to the inside of the ink chamber 5 and the upper portion of the seal blade 3 through the dampening water supplying pipes 31 and 32 functioning as the washing water supplying pipes; the washing water in the ink chamber 5 in recovered to the drainage hopper 10 through the ink supplying pipe 11 functioning as the washing water recovering pipe; the washing water is also recovered to the drainage hopper 10 through the ink returning pipe 21 by the suction of the air gun 8B; and the washing water recovered in the hoppers 22 is recovered to the drainage hopper 10 through the ink returning pipes 23 and 21 by its own weight. This flow of the washing water removes the most of the ink in the ink chamber 5, the hoppers 22, and the pipes 11, 21, and 23. However, the ink still remains at detailed points.

Figure 2D:
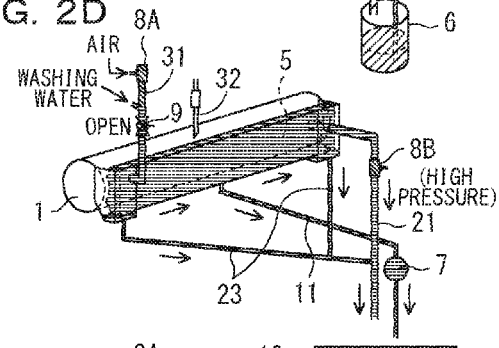

After the washing mode, a forcible washing mode is carried out as illustrated in FIG. 2D. In the forcible washing mode, the open/close valve 9 is opened and the air guns 8A and 8B are activated in high pressure, the dampening water supplier (water tank) 30 on the dampening water supplying pipe 31 side is activated (washing water supplying), and the pump 7 is reversely driven at a high speed. Thereby, the multiphase fluid obtained by putting air into the washing water supplied from the dampening water supplying pipe 31 functioning as a washing water supplying pipe is supplied to the inside of the ink chamber 5, and the washing water in the ink chamber 5 is recovered to the drainage hopper 10 through the ink supplying pipe 11 serving as the washing water recovering pipe; the washing water is recovered to the drainage hopper 10 also through the ink returning pipe 21 by the suction of the air gun 8B; and the washing water recovered by the hoppers 22 is recovered by the drainage hopper 10 through the ink returning pipes 23 and 21 by its own weight. The washing action of the multiphase fluid, that is, an agitating action and a turbulent flow forming action of the washing water by bubbles and an energy of high-velocity flow of the washing water, can efficiently wash the inside of the ink chamber 5 at detailed parts with a small amount washing water.

Figure 2E:
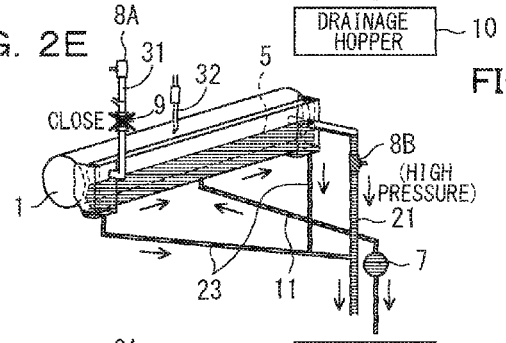

After the forcible washing mode is completed, the washing water is recovered conventionally, but this apparatus carries out a decompression control mode before the recovering of the washing water as illustrated in FIG. 2E. In the decompression control mode, the open/close valve 9 is closed and only the air gun 8B is operated in a high pressure, the dampening water supplier (water tank) 30 is stopped, and the pump 7 is reversely driven at a high speed. Thereby, the inside of the ink chamber 5 is rapidly decompressed to elastically deform the seal blade 3 towards the inside of the ink chamber 5. This deformation generates a gap space between the seal blade 3 and the outer circumference face of the anilox roll 1 (see FIG. 1B), so that the washing water remaining on the seal blade 3 is taken into the inside of the ink chamber 5.

The washing water remaining on the seal blade 3 is accomplished instantly (within an extremely short time).

Figure 2F:
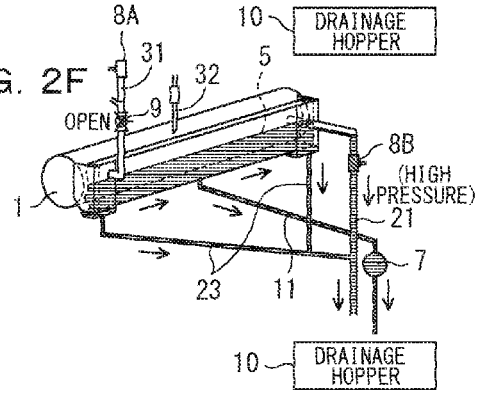

After the decompression control mode is completed, a washing water recovering mode is carried out as illustrated in FIG. 2F. In the washing water recovering mode, the open/close valve 9, which has been closed during the decompression control mode, is opened and only the air gun 8B is operated in high pressure, the dampening water supplier (water tank) 30 is stopped, and the pump 7 is reversely driven at a high speed. Thereby, the washing water in the ink chamber 5 is recovered through the ink supplying pipe 11 into the drainage hopper 10; the washing water is also recovered through the ink returning pipe 21 into the drainage hopper 10 by the suction of the air gun 8B; and the washing water recovered by the hoppers 22 is recovered in the drainage hopper 10 the through the ink returning pipes 21 and 23 by its own weight.

Figure 2G:
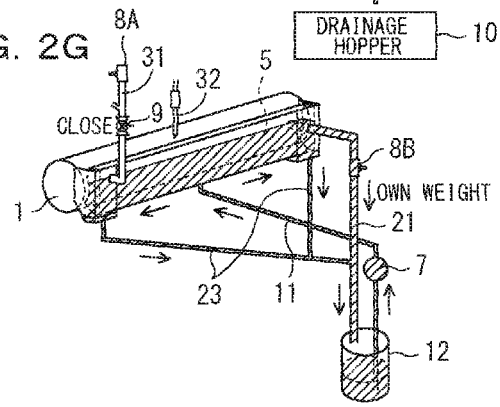

After the washing water recovering mode is completed, the next ink supplying mode is carried out as illustrated in FIG. 2G. In the next ink supplying mode, the open/close valve 9 is closed, the air guns 8A and 8B and the dampening water supplier (water tank) 30 are stopped, and the pump 7 is forwardly driven. A next ink can 12 is replaced by the drainage hopper 10, so that an ink is supplied into the ink chamber 5 through the ink supplying pipe 11. In this mode, a surplus ink returns to the next ink can 12 through the ink returning pipe 21 by its own weight and ink flowing out from the both ends of the ink chamber 5 recovered by the hoppers 22 returns to the next ink can 12 through the ink returning pipes 23 and 21 by its own weight. The pump 7 appropriately switches between the high-speed supplying and the low-speed supplying.

[Operations and Effects]

The apparatus and the method for washing off an ink in the flexographic printing press according to the first embodiment have the above configuration and, in recovering the washing water in the ink chamber 5, decompresses the inside of the ink chamber 5 to elastically deform the seal blade 3 towards the inside of the ink chamber 5, so that the washing water remaining on the seal blade 3 is rapidly drawn into the ink chamber 5. Consequently, the washing water on the seal blade 3 can be rapidly removed.

The washing water supplying path, the washing water supplier, the supplying path opening/closing device, the washing water recovering path, and the suction recovering device are parts of the existing ink supplying/ejecting apparatus (ink circulating apparatus). This inhibits increase of cost to remove the washing water on the seal blade and to wash off the ink.

(Others)

The first embodiment of the present invention is described as above. The present invention is not limited to the foregoing first embodiment, and various changes and modifications can be suggested without departing from the spirit of the present invention.

For example, the above embodiment uses the parts of an existing ink supplying/ejecting apparatus (ink circulating apparatus) as respective part of the apparatus for washing off an ink and thereby the cost is prevented from increasing. Alternatively, the apparatus for washing of an ink of the above embodiment can partially adopt a dedicated member according to the requirement.

With respect to the formation of a multiphase fluid, the air gun 8A may be replaced with another apparatus that takes air using an ejector effect. Alternatively, the air gun 8B may be replaced with a simple suction pump.

The removal of the washing water on the seal blade may be accomplished by an apparatus that washes off an ink with a simple washing water, not with a multiphase fluid.

DESCRIPTION OF REFERENCE NUMBERS

1 anilox roll
2 chamber frame
3 seal blade
4 doctor blade
5 ink chamber
6, 12 ink can (ink tank)
7 ink supplying/recovering pump (ink supplier)
8A air gun (first compressed air supplier)
8B air gun (second compressed air supplier)
9 valve (supplying path open/close device)
10 drainage hopper
11 ink supplying pipe (ink supplying path)
21 ink returning pipe (direct ink recovering path as ink recovering path)
22 hopper
23 ink returning pipe (flowing ink recovering pipe as ink recovering path)
30 dampening water supplier (water tank)
31, 32 dampening water supplying pipe (washing water supplying path)
100 controller

What is claimed is:

1. An apparatus for washing off an ink in a flexographic printing press, the apparatus comprising:

a first washing water supplying path that is connected to an ink chamber, the ink chamber including a seal blade and a doctor blade being in slidable contact with an outer circumference of an anilox roll;

a second washing water supplying path that supplies a top surface of the seal blade with washing water;

a washing water supplier that supplies washing water to an inside of the ink chamber through the first washing water supplying path;

a supplying path opening/closing device that opens and closes the first washing water supplying path;

a washing water recovering path that is connected to the ink chamber;

a suction recovering device that recovers the washing water in the ink chamber by suction through the washing water recovering path; and a controller that controls operations of the washing water supplier, the supplying path opening/closing device, and the suction recovering device accordance with a predetermined control mode, wherein the control mode comprises a decompression control mode in which the seal blade is elastically deformed towards the ink chamber by decompressing the inside of the ink chamber by recovering the washing water by suction generated by activating the suction recovering device and closing the first washing water supplying path by the supplying path opening/closing device.

2. The apparatus according to claim 1, wherein the seal blade is made of a material having a lower stiffness than that of the doctor blade.

3. The apparatus according to claim 1, further comprising an ink supplying path that is connected to the ink chamber;

an ink supplier that supplies ink to the inside of the ink chamber through the ink supplying path; and an ink recovering path that is connected to the ink chamber, wherein:

the ink supplying path and the ink recovering path are used as the washing water recovering path; and the ink supplier is used as the suction recovering device.

4. The apparatus according to claim 1, wherein the ink supplier is a forward-reverse switchable pump that pumps the ink into the inside of the ink chamber when being forwardly driven and sucks the ink in the ink chamber when being reversely driven.

5. The apparatus according to claim 1, further comprising a hopper that is disposed at each end of the ink chamber and that receives an ink flowing from the end, wherein the ink recovering path comprises a flowing ink recovering path that recovers the ink flowing into the hopper, and a direct ink recovering path that is directly connected to the ink chamber.

6. The apparatus according to claim 1, wherein a plurality of the control modes further comprises:

a washing mode in which the inside of the ink chamber is washed through supplying the washing water to the inside of the ink chamber by activating the washing water supplier, under a state where the first washing water supplying path is opened by the supplying opening/closing device, and recovering the washing water in the ink chamber by suction generated by activating the suction recovering device; and a washing water recovering mode in which the washing water in the ink chamber is recovered by suction through stopping the washing water supplier, under a state where the first washing water supplying path is opened by the supplying path opening/closing device, and activating the suction recovering device, wherein the controller carries out the washing mode and the washing water recovering mode in this order, and carries out the decompression control mode immediately before the washing water recovering mode.

7. The apparatus according to claim 1, further comprising a first compressed air supplier that is provided for the washing water supplier and that mixes compressed air with the washing water to be supplied and flows a multiphase fluid including a gas phase and a fluid phase inside the ink chamber.

8. The apparatus according to claim 7, wherein:

the washing water supplier comprises a washing water tank that is disposed above the ink chamber and that supplies the washing water using an own weight of the washing water, and a plurality of the control modes further comprises:

a washing mode in which the inside of the ink chamber is washed through supplying the washing water to the inside of the ink chamber using the own weight of the washing water by activating the washing water supplier, under a state where the first washing water supplying path is opened by the supplying path opening/closing device, and recovering the washing water in the ink chamber by suction through activating the suction recovering device;

a forcible washing mode in which the inside of the ink chamber is washed through forcibly suppling the multiphase fluid to the inside of the ink chamber by activating the washing water supplier and the first compressed air supplier, under a state where the first washing water supplying path is opened by the supplying path opening/closing device, and recovering the washing water in the ink chamber by suction generated by activating the suction recovering device; and a washing water recovering mode in which the washing water in the ink chamber is recovered by suction through stopping the washing water supplier, under a state where the first washing water supplying path is opened by the supplying path opening/closing device, and activating the suction recovering device, and the controller carries out the washing mode, the forcibly washing mode, and the washing water recovering mode in this order, and carries out the decompression control mode immediately before the washing water recovering mode.

9. The apparatus according to claim 1, further comprising a second compressed air supplier that is included in the washing water recovering path and that enhances the recovering of the washing water by mixing compressed air with the washing water to be recovered in a direction of the recovering.

10. The apparatus according to claim 1, wherein the controller sequentially carries out a plurality of the control modes on a predetermined schedule.

11. A method for washing off an ink in a flexographic printing press, the method comprising:

washing an inside of an ink chamber by suppling the inside of the ink chamber and a top surface of a seal blade with washing water, the ink chamber comprising the seal blade and a doctor blade being in slidable contact with an outer circumference of an anilox roll; and after the washing, recovering the washing water in the ink chamber, immediately before the recovering, decompressing the inside of the ink chamber to elastically deform the seal blade towards the ink chamber.

12. The method according to claim 11, wherein the washing supplies the washing water by an own weight of the washing water; and the method further comprising, between the washing and the decompressing, forcibly washing the inside of the ink chamber by forcibly flowing a multiphase fluid including a gas phase and a fluid phase in the ink chamber, the multiphase fluid being generated by mixing compressed air with the washing water.

* * * * *